US005954128A

United States Patent [19]

Harkins et al.

[11] Patent Number: 5,954,128

[45] Date of Patent: Sep. 21, 1999

[54] HIGH PRESSURE CERAMIC HEAT EXCHANGER

[75] Inventors: Bruce D. Harkins, San Diego; Michael E. Ward, Poway, both of Calif.

[73] Assignee: Solar Turbines, San Diego, Calif.

[21] Appl. No.: 08/611,861

[22] Filed: Mar. 6, 1996

[51] Int. Cl.[6] ..... F28F 9/013

[52] U.S. Cl. ..... 165/173; 165/142; 165/180; 165/906

[58] Field of Search ..... 165/134.1, 173, 165/175, 180, 906, 142, 176, 178

[56] References Cited

U.S. PATENT DOCUMENTS

| | | | |
|---|---|---|---|
| 2,225,634 | 12/1940 | Houdry | 165/176 X |
| 3,922,411 | 11/1975 | Motta et al. . | |
| 4,106,556 | 8/1978 | Heyn et al. | 165/142 X |
| 4,269,266 | 5/1981 | Coates, Jr. et al. | 165/142 |
| 4,330,031 | 5/1982 | Shefsiek | 165/142 X |
| 4,431,049 | 2/1984 | Zamma et al. | 165/142 |
| 5,265,918 | 11/1993 | Ward et al. . | |

FOREIGN PATENT DOCUMENTS

| | | |
|---|---|---|
| 4102909 | 8/1992 | Germany . |
| 2143812 | 2/1985 | United Kingdom . |

*Primary Examiner*—Leonard R. Leo
*Attorney, Agent, or Firm*—Larry G. Cain

[57] ABSTRACT

Many recuperators have components which react to corrosive gases and are used in applications where the donor fluid includes highly corrosive gases. These recuperators have suffered reduced life, increased service or maintenance, and resulted in increased cost. The present header assembly when used with recuperators reduces the brittle effect of a portion of the ceramic components. Thus, the present header assembly used with the present recuperator increases the life, reduces the service and maintenance, and reduces the increased cost associated with corrosive action of components used to manufacture recuperators. The present header assembly is comprised of a first ceramic member, a second ceramic member, a reinforcing member being in spaced relationship to the first ceramic member and the second ceramic member. The header assembly is further comprised of a refractory material disposed in contacting relationship with the first ceramic member, the second ceramic member and the reinforcing member and having a strengthening member wrapped around the refractory material. The present header assembly provides a high strength load bearing header assembly having good thermal cycling characteristics, good resistance to a corrosive environment and good steady state strength at elevated temperatures.

24 Claims, 4 Drawing Sheets

HIGH PRESSURE CERAMIC HEAT EXCHANGER

"The Government has the rights in this invention pursuant to Contract No. DE-FC02-88ID12799 awarded by the U.S. Department of Energy."

TECHNICAL FIELD

This invention relates generally to a ceramic joint construction utilized in a recuperator or heat exchanger tube assembly and more particularly to strengthening of a refractory used within the joint.

BACKGROUND ART

Present day recuperators and heat exchangers typically used a combination of metal component and ceramic components which must be bonded together. When using dissimilar materials, the joint therebetween is difficult to form, and the use of metal components has several major drawbacks. For example, metal components used in the recuperator or heat exchanger are susceptible to high temperatures and highly corrosive gases. Thus, the use of ceramic materials within recuperator and heat exchanger application to resist high temperature and high corrosive conditions has become necessary to provide longevity, serviceability and quality for future applications.

Additional problems are encountered in adapting ceramic material to high temperature heat exchangers. One of the biggest problem with present tube-type ceramic recuperators centers around the strength of the refractory used with header joints. Refractory materials are generally brittle. Specifically, composite ceramic-metal heat exchangers have problems attributable to stresses resulting from unlike thermal expansion characteristics of the diverse materials. The stresses can cause structural failure and fluid leakage between the high and low pressure sides of the heat exchanger. Additionally, present ceramic-metal heat exchangers are difficult to service and repair.

The increased use of ceramic materials has further emphasized the need for joining ceramic material to other ceramic materials. U.S. Pat. No. 4,784,313 which issued Nov. 15, 1988, to Jerzy Godziemba-Maliszewski, describes a method for bounding silicon carbide molded parts together or which ceramics or metal parts. The above patent discloses that SiC can be firmly bonded to itself or to molded bodies of other ceramic material or to metal work pieces by the establishment of diffusion-welding condition when a metal alloy layer is interposed between cleaned and polished surfaces.

In U.S. Pat. No. 4,642,864, issued Feb. 17, 1987 to Arthur G. Metcalfe et al., a joint construction for joining ceramic and metallic components for use in a recuperator or heat exchanger tube assembly is disclosed. The joint includes a bonding material cast between a ceramic tube and a metal member. The joint further has a seal member with sufficient ductility within a predetermined thermal operating range which will plastically deform and yet maintain an effective fluid seal between the ceramic and metal members.

In U.S. Pat. No. 5,265,918, issued Nov. 30, 1993 to Michael E. Ward and Bruce D. Harkins, a joint construction for joining ceramic to ceramic components for use in a recuperator or heat exchanger tube assembly is disclosed. The joint includes a refractory material disposed in a groove forming a mechanical locking device. The joint provides a high strength load bearing joint having good thermal cycling characteristics, good resistance to corrosive environment and good steady state strength at elevated temperatures.

The present invention is directed to overcoming one or more of the problems set forth above.

DISCLOSURE OF THE INVENTION

In one aspect of the present invention, a header assembly is comprised of a first ceramic member, a second ceramic member being in spaced relationship to the first ceramic member, a reinforcement member being position in spaced relationship to the first ceramic member and the second ceramic member, a refractory material contacting the first ceramic member, the second ceramic member and the reinforcement member and maintaining the spaced relationship and a strengthening member being wrapped about the refractory material.

BEST MODE FOR CARRYING OUT THE INVENTION

Figure 1:
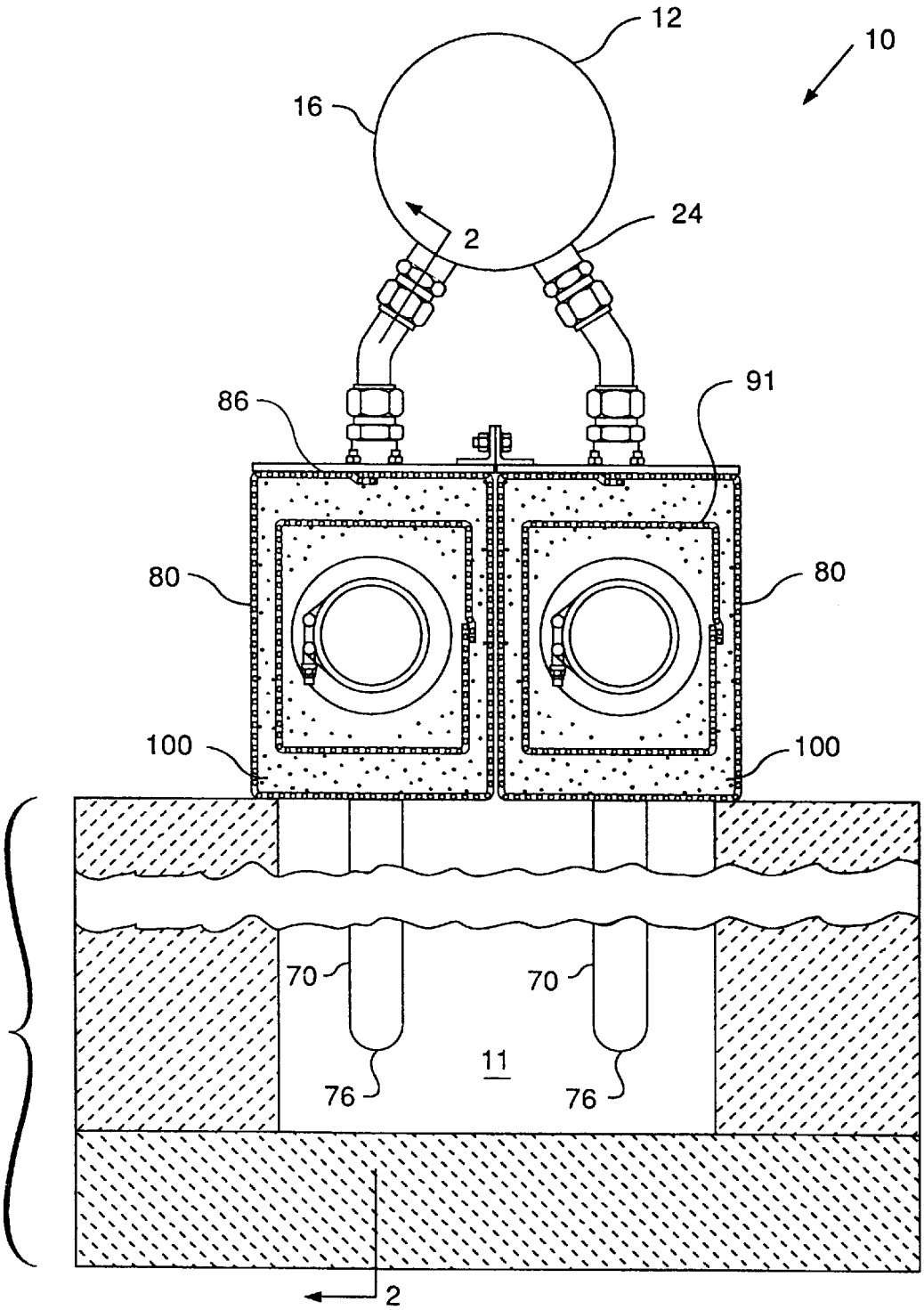
FIG. 1 is a sectional view of a duct and a recuperator embodying the present invention.
Figure 2:
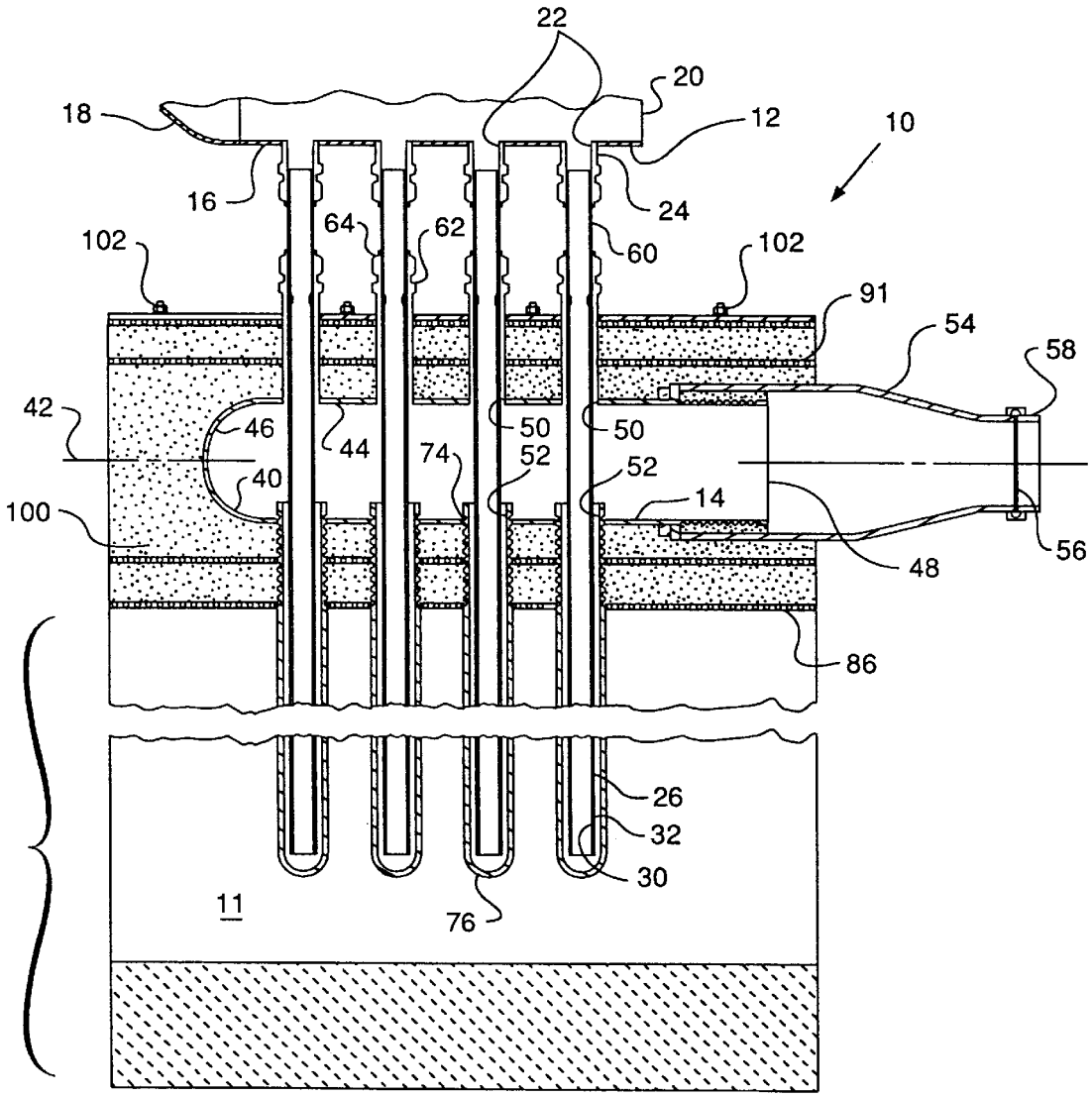
FIG. 2 is an enlarged sectional view of a portion of a fiber reinforced refractory material having a reinforcement member therein and a strengthening member therearound taken along lines 2—2 of FIG. 1.

As best shown in FIGS. 1 and 2, a recuperator or heat exchanger 10 is shown being at least partially positioned within a duct 11. The heat exchanger 10 includes an air inlet manifold 12 and an air outlet manifold 14. The air inlet manifold 12 has a generally cylindrical configuration and is substantially formed by a cylindrical wall 16 having a closed end 18 and an open end 20. The air inlet manifold 12 is made from a metal cylinder and the closed end 18 is formed thereon. A plurality of openings 22 are defined in the wall 20 and are axially positioned in preestablished spaced relation one to another. A metallic tube 24 is disposed within each of the plurality of openings 22 and is fixedly attached thereto in a conventional manner. As further shown in FIG. 2, each of the metallic tubes 24 is comprised of a wall 26 defined by an outer diameter and an inner diameter. The wall 26 further defines an inner cylindrical surface 30 and an outer cylindrical surface 32. Each of the tubes 24 have opposite ends which are open. The end of the tube 24 which is disposed within the opening 22 extends beyond the wall 16 a preestablished length.

The air outlet manifold 14 includes a ceramic composite member or first ceramic member 40 having a generally cylindrical configuration defining an axis 42. The first ceramic member 40 includes a cylindrical wall member 44 having a closed end 46 and an open end 48. The first ceramic member 40 which can be made of a continuous fiber reinforced ceramic composite material of silicon carbide/silicon carbide composite. Nicalon fiber, a silicon carbide is used as the fiber for fabrication of the preform and the matrix deposition process to form the composite material. A plurality of apertures 50 are defined within the cylindrical wall member 44 and are axially spaced apart to coincide with the preestablished spaced relationship of the plurality of openings 22 in the air intake manifold 12. A plurality of openings 52 are defined within the cylindrical wall member 44 opposite the plurality of apertures 50 and are axial aligned therewith. The open end 48 of the first ceramic member 40 is surrounded by a metallic ring 54 having an attachment flange 56 thereon. The metallic ring 54 is sealingly attached to the first ceramic member 40. The attachment flange 56 has a duct 58 attached thereto to fluidly communicate the heated gaseous fluid away from the heat exchanger 10. A plurality of tubes 60 are sealingly positioned within the apertures 50 and have a threaded end 62 extending beyond the cylindrical wall member 44. Each of the tubes 60 have a threaded nut 64 being sealedly attached thereto.

A plurality of ceramic tubes or second ceramic members 70 are positioned within the openings 52 defined within the first ceramic member 40. Each tube 70 is positioned within each of the openings 52 in spaced relationship thereto. A sealed joint 74 is formed between the ceramic header 40 and each of the ceramic tubes 70.

Each of the ceramic tubes 70 has a hollow, elongate ceramic tube configuration. Each tube 70 is formed of a ceramic material. Like the first ceramic member 40, each of the tubes 70 is a monolithic silicon carbide structure.

As further shown in FIGS. 1 and 2, the outer diameter of each metallic tube 24 is less than the inner diameter of each ceramic tube 70. Each of the metallic tubes 24 coaxially extends inside one of the ceramic tube 70 so that the distal end of the metallic tube 24 is near a closed end 76 of the ceramic tube 70. The positioning of each of the plurality of metallic tubes 24 within the plurality of ceramic tubes 70 forms a tube-within-a-tube relationship. The outer surfaces 32 of each of the metallic tubes 24 can be maintained in concentric relationship with the ceramic tube 70 by suitable spacers, not shown.

Figure 3:
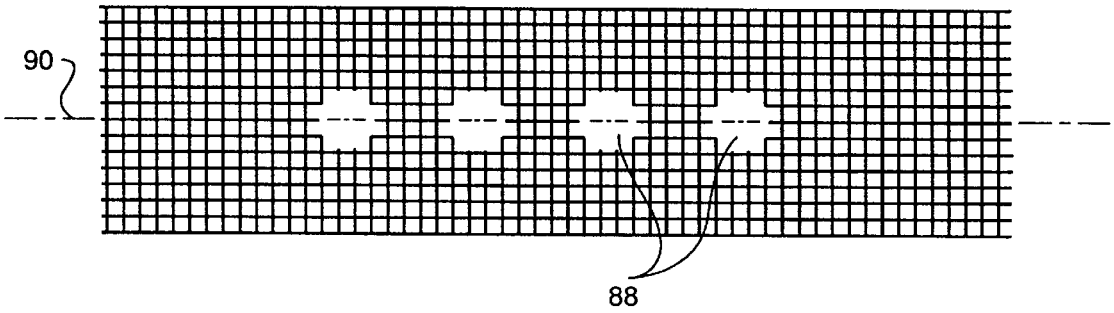
FIG. 3 is an enlarged elevational view of a portion of the reinforcement member.
Figure 4:
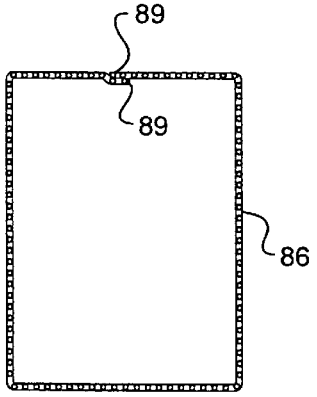
FIG. 4 is an end view of the strengthening reinforcement member.
Figure 5:
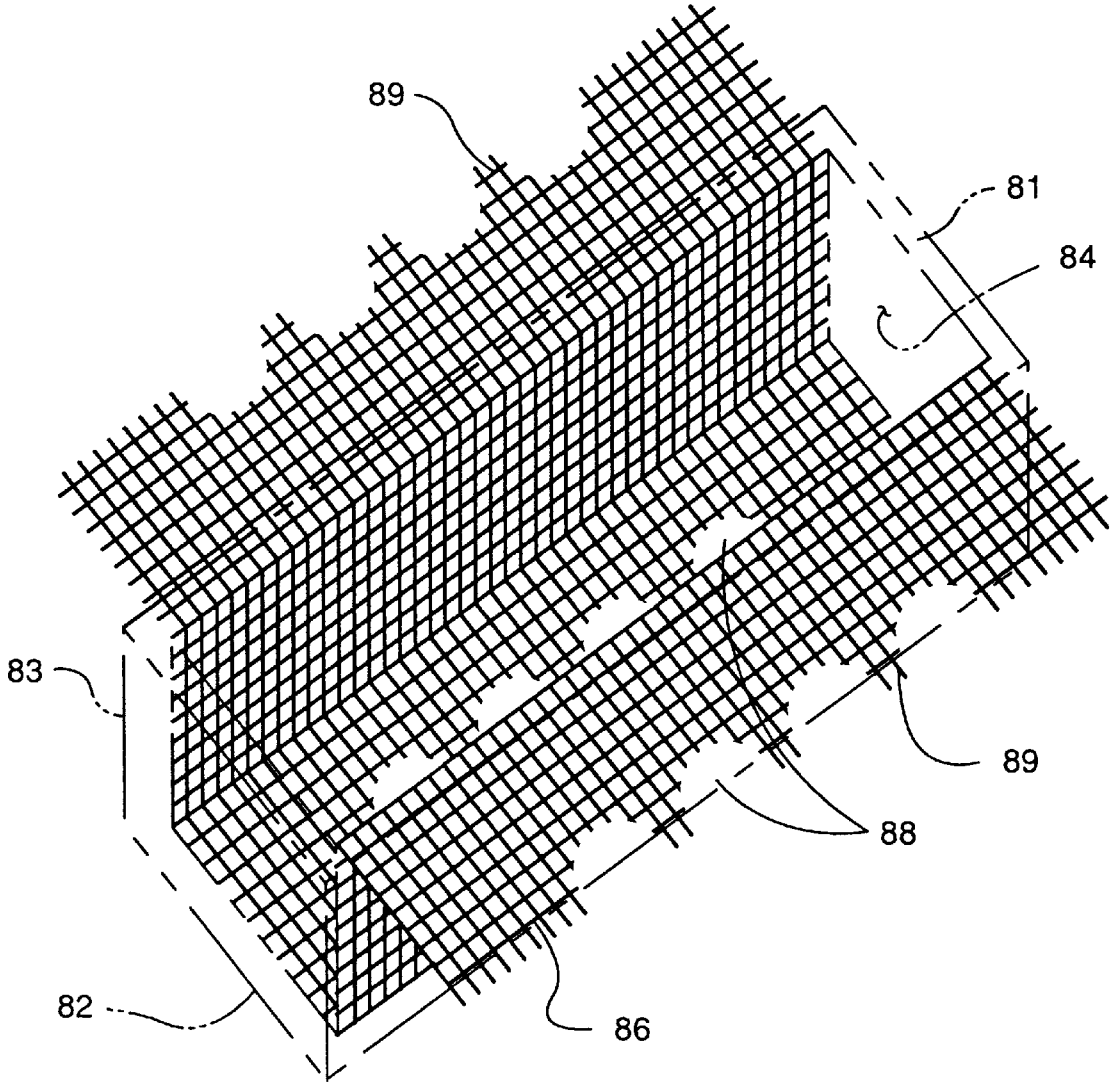
FIG. 5 is an enlarged pictorial view of a mold shown in phantom having the strengthening member therein.

A mold or casing, as shown in phantom in FIG. 5, is used to form a header assembly 80 having a generally rectangular configuration defining a top 81, a bottom 82, a pair of sides 83 and a pair of ends 84. The mold, in this application, has a generally rectangular configuration being formed by a bottom, a pair of ends and a pair of sides having a plurality of openings defined therein corresponding in position to the plurality of tubes 60 and the ceramic tubes 70. As best shown in FIG. 5, a strengthening member 86 being constructed of a ceramic woven cloth mesh has a plurality of openings 88 defined therein corresponding to the position of the plurality of tubes 60 and the ceramic tubes 70. The strengthening member 86 is positioned within the mold in contacting relationship with the bottom and the pair of sides and in the assembled position the plurality of openings 84 nest about the plurality of tubes 60 and the ceramic tubes 70. The strengthening member 86 does not overlap the ends of the mold. A pair of ends 89 of the strengthening member 86 extends beyond the sides of the mold a preestablished distance. As best shown in FIGS. 3 and 5, the strengthening member 86 extends along an axis 90 generally corresponding to the axis 42 of the first ceramic member 40. In this application, the strengthening member 86 is a Nextel 312 Fabric, leno weave 0.2 tow spacing in wrap and fill direction. The first ceramic member 40 is positioned in the mold in spaced relationship thereto Eorming a void or chamber or cavity therearound. In this application, the spacing around the first ceramic member 40 from the mold is generally uniform or equal. As an alternative, the mold could have a generally square or possibly a cylindrical configuration. Further shown in FIGS. 1 and 2, positioned within the mold and spaced from the mold and the first ceramic member 40 is a reinforcement member 91. As best shown in FIGS. 3 and 4, the reinforcement member 91 extends along the axis 42 of the first ceramic member 40, is spaced from the first ceramic member 40 a preestablished distance and is spaced from the mold a preestablished distance. In this application, the preestablished distance from the first ceramic member 40 and the mold is equal. However, as an alternative, the spacing from the first ceramic member 40 and the mold could be varied without changing the essence of the invention. The reinforcement member 91 surrounds the first ceramic member 40 and includes a plurality of openings, not shown, therein positioned in corresponding relationship to the location of the plurality of tubes 60 and the ceramic tubes 70. The plurality of openings are sized to provide clearance between the reinforcement member 91, and the plurality of tubes 60 and the ceramic tubes 70. To surround the first ceramic member 40, the reinforcement member 91 is formed from a sheet, bent into the rectangular configuration and has the ends of the sheet overlapping each other at a generally middle point on a side. The overlapping portion of the reinforcement member 91 is rigidly connected. The reinforcing member 91 further has a plurality of fasteners 96 attached thereto. The plurality of fasteners 96 are spaced apart along the axis 42 and are alternately offset one from another. In this application, the reinforcing member 91 is constructed from 3 mm diameter stainless steel wire having a 50 mm×50 mm mesh. As an alternative, the construction of the reinforcing member 91 could be that of a stainless steel expanded metal flattened mesh. Although the mesh is this application is made of stainless steel other materials such as plastic could be used. The essential characteristics of the reinforcement member 91 are that a portion of the reinforcement member 91 should extend substantially the entire axial length of the header assembly 80, surround the ceramic member 40 and provide openings or spaces between the extension such as are formed in a mesh. However, as an alternative, the reinforcement member 91 could be slightly shorter than the axial length of the header assembly 80 such as by about 12 mm, and may not totally surround the ceramic member 40, such as being of a "U" configuration being void of a complete or closed loop.

A glue or filler, such as epoxy, not shown can be used to position the ceramic tubes 70, the plurality of tubes 60 and the reinforcing member 91 in spaced relationship to the first ceramic member 40 prior to pouring a refractory material 100 into the chamber. The refractory material 100 is in a slurry form and when poured into the chamber within the mold comes into contact with the strengthening member 86 and flows within the mesh portion thereof. The refractory material 100 nests around the first ceramic member 40, the plurality of tubes 60, the ceramic tubes 70 and within the mesh of the reinforcing member 91 filling the chamber without forming voids. With the refractory material 100 in the slurry state, the predetermined length of the pair of ends 89 of the strengthening material 86 extending beyond the mold are folded about the refractory material 100 to a position in which the pair of ends 89 overlap. A plurality of fasteners 102, as shown in FIG. 2, being made of stainless steel can be used to further attach the strengthening member 86 to the refractory material 100. To insure the absence of voids, the mold can be vibrated while the refractory material 100 is in the slurry state. In this application, the refractory material 100 is fiber reinforced and attaches to the strengthening member 86, the fasteners 102, the first ceramic member 40, the plurality of tubes 60, the ceramic tubes 70 and the reinforcing member 91. The refractory material 100, in this application, is a dense castable material having a composition by weight, of about 70% $Al_2O_3$, 25% $SiO_2$, and 5% trace elements. One such commercially available material is sold by Babcock and Wilcox Co., New York, N.Y., under the trademark name Kaocrete 32-C. This material, as purchased is a mixture of aggregate and fine particles, the fine particles comprise about 60% of the total mixture and are defined as that portion of the mixture that will pass a no. 18 sieve, i.e., a sieve having a nominal opening of about 1.0 mm. The fiber reinforcement use is this application is steel fibers or whiskers which is mixed in the ratio of about 1.4 kgs of fibers to every 45.4 kgs of refractory. However, if corrosion occurs and degradation of strength is determined to be a major problem, the use of high strength alloy fibers can be substituted to reduce the corrosion.

After the refractory material 100 has hardened, the mold is removed and the heat exchanger 10 having the reinforcing member 91 positioned therein and the strengthening member 86 wrapped therearound is assembled and positioned within the conventional furnace or flue gas duct 11.

Industrial Applicability

In application, the recuperator 10 includes the header assembly 80 assembled in the following manner. The metallic tubes 24 are positioned within the respective plurality of openings 22 within the cylindrical wall 16 of the air inlet manifold 12 and are fixedly attached to the wall 16. After assembly, the internal surface of the inlet manifold 12 is coated with the refractory material in a conventional manner. Next, strengthening member 86 is positioned within the mold along with the reinforcing member 91 positioned about the first ceramic member 40, the respective tubes 60 are inserted through corresponding ones of plurality of openings 88 in the strengthening member 86 and the plurality of openings 94 in the reinforcement member 91 and into corresponding ones of the plurality of apertures 50 in the first ceramic member 40. In addition, respective ceramic tubes 70 are inserted through corresponding ones of the plurality of openings 88 in the strengthening member 86 and the plurality of openings 94 in the reinforcement member 91 and into corresponding ones of the plurality of openings 52 in the first ceramic member 40. Furthermore, the threaded nut 64 with the seal 66 positioned therein is threadedly engaged onto the threaded end 62 of each of the tubes 60. The assembled nut 64 and sealingly position the tubes 60 about the outer surface 32 of respective tubes 24 and the nut 64 is tighten on the threaded end 62 and positions the tubes 60 relative to the air inlet manifold 16 and the tubes 24 relative to the ceramic tubes 70. And, the metallic ring 54 is sealingly attached to the first ceramic member 40. Glue can be added to the interface of the tubes 24 and the air inlet manifold 16, the tubes 60 and the first ceramic member 40 and the ceramic tubes 70 and the first ceramic member 40 to maintain the relative position therebetween.

Thus, the header assembly 80 is ready to be formed. The refractory material 100 is poured or cast into the cavity formed by the spaced relationship of the components and the mold. Thus, the fiber reinforced refractory material 100 after drying fixedly attaches the components. For example, the castable refractory material 100 flows into the cavity formed by the spaced relationship of the components and the mold, comes into contact with the strengthening member 86 filling the voids in the mesh, fills the spacing within the mesh of the reinforcing member 91 and contacts therewith, contacts the cylindrical wall member 44, contacts the tubes 60 and contacts the ceramic tubes 70. Prior to the refractory material 100 becoming hard, the ends 89 of the strengthening member 86 are extended over the refractory material 100 to a position where the ends 89 are in an overlapping position. At this point, a vibrator is attached to the mold and the refractory material 100 settles into any voids. Thus, a mechanical joint is formed which provides a high strength load bearing header assembly 80 having good thermal cycling characteristics, good resistance to a corrosive environment and good steady state strength at elevated temperatures.

The header assembly 80 having the strengthening member 86 wrapped therearound is used with the recuperator or heat exchanger 10 which is partially disposed within the flue gas duct 11 in a conventional manner of a conventional furnace. During operation of the recuperator 10 within the flue gas duct 11 and the strengthening member 86 and the reinforcing member 91 aid to increase the strength of the header assembly 80 by reducing the effects of the brittleness of the refractory material 100. In operation, high pressure gaseous fluid or recipient fluid, which in this application is air, to be heated, enters the open end 20 of the inlet manifold 12. From the inlet manifold 12, the air passes through the tubes 24 and exits the open end of each of the tubes 24. The air passes along the ceramic tube 70 absorbing heat from the high temperature low pressure gases or donor fluid of combustion passing through the duct 11. The heated air rises between the outer surfaces 32 of the tubes 24 and the ceramic tubes 70 and exits into the air outlet manifold 14. The heated air exits the outlet manifold 14 through the metallic ring 54 and is used in a conventional manner.

The strengthening member 86 provides an effective reinforcement even through the more brittle refractory material 100 may crack under repeated thermal stress loading. The interlaced characteristics of the mesh type strengthening member 86 helps to compensate for the brittle characteristic of the refractory material 100 increasing the effective life of the header assembly 80.

Other aspects, objects and advantages will become apparent from a study of the specification, drawings and appended claims.

What is claimed is:

1. A header assembly being adapted for use with a heat exchanger tube assembly comprising:

a first ceramic member defining an opening therein;

a second ceramic member being positioned within said opening and in spaced relationship to said opening in said first ceramic member;

a reinforcement member being spaced from said first ceramic member, and having an opening therein positioned about said second ceramic member;

a refractory material contacting said first ceramic member, said second ceramic member and said reinforcement member and maintaining said spaced relationship; and a strengthening member being wrapped about said refractory material whereby operatively increasing the strength of said refractory material and forming said header assembly.

2. The header assembly of claim 1 wherein said strengthening member is an interwoven mesh being formed from a ceramic fiber.

3. The header assembly of claim 2 wherein said strengthening member has a pair of ends being overlapped.

4. The header assembly of claim 2 wherein said refractory material nests within the mesh.

5. The header assembly of claim 1 wherein said strengthening member has a plurality of fasteners attached to the refractory material.

6. The header assembly of claim 1 wherein said header assembly includes a generally rectangular configuration having a top, a bottom, a pair of sides and a pair of ends and said strengthening member is wrapped around the top, bottom, and the pair of sides.

7. The header assembly of claim 6 wherein said pair of sides has a preestablished length and said strengthening member extends generally in line with the preestablished length of the pair of sides.

8. The header assembly of claim 1 wherein said reinforcement member includes a mesh type configuration.

9. The header assembly of claim 8 wherein said reinforcement member surrounds the first ceramic member.

10. The header assembly of claim 9 wherein said reinforcement member has a generally rectangular configuration.

11. The header assembly of claim 10 wherein said rectangular configuration being formed from a sheet having the ends overlapping.

12. The header assembly of claim 11 wherein said ends overlap at a generally middle point of a side of the rectangular configuration.

13. The header assembly of claim 11 wherein said overlapping ends are rigidly connected.

14. The header assembly of claim 1 wherein said reinforcing member includes a plurality of fastener being attached thereto.

15. The header assembly of claim 14 wherein said plurality of fasteners are axially spaced along the reinforcing member and are off-set from adjacent ones of the plurality of fasteners.

16. The header assembly of claim 1 wherein said refractory material includes a fiber reinforcement.

17. The header assembly of claim 16 wherein said fiber reinforcement is added to said refractory material in a ratio of about 0.3 to 2 kgs of reinforcement to about every 45.4 kgs of refractory.

18. The header assembly of claim 17 wherein said fiber reinforcement added to said refractory material is in the ratio of about 1.4 kgs to 45.4 kgs respectfully.

19. The header assembly of claim 1 wherein said refractory material is a dense cartable refractory material.

20. The header assembly of claim 19 wherein said refractory material comprises a blend of about 40% by weight aggregate particles and about 60% by weight fine particles.

21. The header assembly of claim 20 wherein said refractory material is a composition of 70% by weight $Al_2O_3$, 25% by weight $So_2$, and 5% by weight trace elements.

22. The header assembly of claim 21 wherein said mechanical connection has a strength which is dependent on said refractory material having a preestablished particle size and particle size distribution.

23. The header assembly of claim 22 wherein said refractory material comprises a blend of about 40% by weight aggregate particles and about 60% by weight fine particles.

24. The header assembly of claim 23 wherein said fine particles are defined as that portion of said refractory material passing through a sieve having a 1.0 mm opening.

* * * * *